United States Patent [19]

Halboth

[11] 4,141,309

[45] Feb. 27, 1979

[54] INBOARD POWERED WATERCRAFT

[76] Inventor: Robert V. Halboth, 2177 S. 35th St., Milwaukee, Wis. 53215

[21] Appl. No.: 817,500

[22] Filed: Jul. 21, 1977

Related U.S. Application Data

[63] Continuation-in-part of Ser. No. 759,338, Jan. 14, 1977, abandoned.

[51] Int. Cl.[2] ..... B63B 35/72

[52] U.S. Cl. ..... 115/70; 114/61; 115/42

[58] Field of Search ..... 115/70–72, 115/1 R, 39, 42; 114/61; 180/5R; 248/23

[56] References Cited

U.S. PATENT DOCUMENTS

| | | | |
|---|---|---|---|
| 2,896,565 | 7/1959 | Stevens | 115/42 |
| 3,066,898 | 12/1962 | Haynes | 248/23 |
| 3,521,718 | 7/1970 | Masaoka et al. | 180/5 R |
| 3,646,904 | 3/1972 | Lanning et al. | 115/1 R |
| 3,698,497 | 10/1972 | Bombardier | 180/5 R |
| 3,773,127 | 11/1973 | Aaen et al. | 180/5 R |
| 3,853,085 | 12/1974 | Halboth | 115/1 R |

*Primary Examiner*—Trygve M. Blix
*Assistant Examiner*—Sherman D. Basinger
*Attorney, Agent, or Firm*—Andrus, Sceales, Starke & Sawall

[57] ABSTRACT

A pontoon, catamaran-type watercraft is generally complete lacking only an engine. The watercraft is rigged with a universally adjustable mount for an engine. To effect conversion, it is contemplated that a snowmobile engine with appurtenant variable sheave centrifugal pulley will be mounted in proper alignment and at a desired distance from a variable sheave centrifugal pulley provided on the watercraft ab initio.

8 Claims, 5 Drawing Figures

INBOARD POWERED WATERCRAFT

BACKGROUND OF THE INVENTION

This application is a continuation-in-part of the applicant's copending application Ser. No. 759,338, filed Jan. 14, 1977 and now abandoned.

The applicant's earlier U.S. Pat. No. 3,853,085 entitled "Snowmobile Powered Watercraft" provides for the driving of a pontoon type watercraft by a somewhat modified snowmobile. The patented structure is fully capable of attaining planing speeds and thus offers many of the same pleasures as other powered watercraft. For some, the physical arrangement with the snowmobile is even more pleasurable than more conventional watercraft.

Some owners of snowmobiles, however, are reluctant to commit their machines for such a purpose. Others do not possess the know-how, mechanical skill and/or patience required for the conversion of the machine and its proper mounting onto the hull of a watercraft. It is generally an object of this invention to make watercraft having the general physical arrangement of a snowmobile more attractive to those owners of snowmobiles who are reluctant to commit their entire machines and/or are mechanically not so inclined.

The invention contemplates a watercraft generally including the physical arrangement of a snowmobile and being generally complete except for an engine and appurtenant variable sheave centrifugal pulley. The removal of the engine from a snowmobile and its installation on the watercraft of this invention are relatively simple procedures generally within the capability of most novices. The engine only conversion consumes but a small fraction of the time when compared to the time required for the conversion contemplated in U.S. Pat. No. 3,853,085. Other advantages of this invention over the earlier patented structure include a lower disposition of the propeller shaft to a near horizontal condition so as to impose substantially less drag on the watercraft, and less weight and a better distribution of that weight on the watercraft.

SUMMARY OF THE INVENTION

The invention contemplates a pontoon, catamaran-type watercraft generally as described in applicant's earlier U.S. Pat. No. 3,853,085. The watercraft is rigged ab initio with complete steering apparatus, seating, cowl enclosure, and a drive train for the propeller lacking only the engine and variable sheave centrifugal pulley carried on the engine shaft. The watercraft is rigged with means for universally mounting a snowmobile engine in a generally horizontal plane to place the variable sheave pulley on the engine shaft in proper alignment and at the desired distance from the variable sheave pulley provided ab initio on the watercraft.

DESCRIPTION OF THE DRAWING FIGURES

The drawings furnished herewith illustrate the best mode presently contemplated for carrying out the invention and are described hereinafter.

DESCRIPTION OF THE ILLUSTRATED EMBODIMENT

Figures 1, 3:
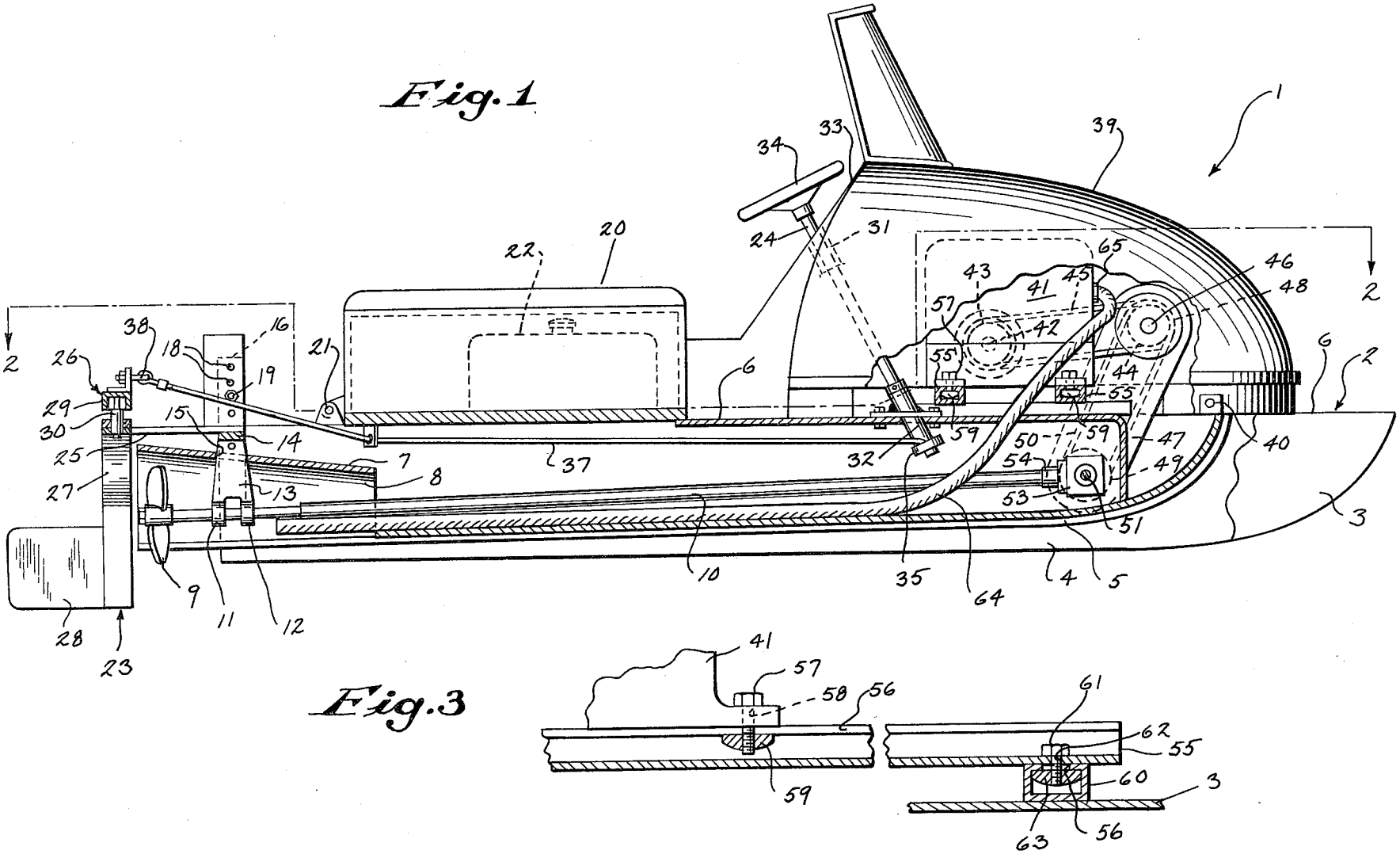
FIG. 1 is a side elevation of the watercraft of this invention with parts broken away and sectioned.
FIG. 3 is a sectional view taken generally on the line 3—3 of FIG. 2.

Referring to the drawings, the watercraft 1 includes a catamaran-type hull 2 having a pair of transversely spaced pontoons 3 and 4. Pontoons 3 and 4 may be air-tight sheet metal weldments that maintain their form and resist drag due to flexing by air under pressure contained therein.

The pontoons 3 and 4 are connected by a transversely extending lift plate 5 whose forward edge is spaced rearwardly from the forward edge of the pontoons. Forwardly the plate 5 is bowed upwardly to place the forward edge thereof generally level with the deck surface 6. The lift plate 5 extends rearwardly and downwardly in spaced relation above the bottom of the pontoons 3 and 4 and terminates in spaced relation from the rear of the pontoons. The pontoons 3 and 4 are also connected by a wake plate 7 which extends rearwardly beyond the rear ends of the pontoons from the rear terminus of the lift plate 5. The wake plate 7 is generally arcuate in the transverse direction to present a concave face downwardly and forms the opening 8 at the forward extremity thereof with the lift plate.

The arcuate wake plate 7 extends over the propeller 9 rotatably carried on the end of shaft 10. The shaft 10 is generally disposed at the longitudinal centerline of the watercraft 1 and extends through the opening 8 and is rotatably supported in longitudinally spaced bearings 11 and 12 intermediate the opening and the propeller 9. Bearings 11 and 12 are carried by the vertical strut 13 which depends from the cross member 14 through a hole 15 in the wake plate 7. Cross member 14 extends between the opposed vertical channel members 16 secured to the opposed inner faces of the pontoons 3 and 4 adjacent to the ends thereof. The opposed ends of cross member 14 are provided with upwardly projecting arms 17 adjacent to the fixed channel members 16. The spaced arms 17 are provided with a series of vertically spaced and transversely aligned openings 18 which are selectively aligned with an opening, not shown, in the channel members 16 to provide for vertically adjusting movements of the shaft 10 to place the propeller 9 at the desired operating depth. The vertical adjustment between the movable arms 17 and fixed channel members 16 is maintained by the pins 19 extending therethrough.

The watercraft 1 carries a suitable seat 20 generally rearwardly on the deck surface 6 thereof. The seat 20 is hinged rearwardly at 21 for pivotal movement to the rear to provide for exposure of the fuel reservoir 22.

Steerage for the watercraft 1 is provided for by the rudder assembly 23 as controlled from the steering column 24. The rudder assembly 23 is disposed immediately behind the propeller 9 and carried by a U-shaped member 25 projecting rearwardly from and supported by the cross member 14. Thus, the rudder assembly 23 is vertically adjustable with the propeller 9. The assembly 23 comprises an inverted U-shaped frame 26 having depending legs 27 that carry the transversely spaced rudder plates 28. The generally horizontal intermediate portion 29 of frame 26 is pivotally mounted on member 25 by the vertical pin 30 disposed generally on the longitudinal centerline of the watercraft 1 to provide for pivotal steering in a generally horizontal plane. The spacing of the rudder plates 28 as provided by the frame 26 places the respective plates in solid water in the wake of the corresponding pontoons 3 and 4 on opposite sides of the propeller 9.

The steering column 24 is mounted in vertically spaced bearings 31 and 32 supported by the dashboard 33 and deck 6, respectively, and mounts a steering wheel 34 or the like at the upper end thereof. Beneath the lower bearing 32, the steering column 24 carries the opposed arms 35 and 36 shown in transversely extended position for straight ahead operation. Steering cables 37 are attached adjacent to the ends of the respective arms 35 and 36 and extend rearwardly therefrom beneath the deck for attachment to the eye bolts 38 spaced on either side of the pivot pin 30 and secured to the intermediate portion 29 of the rudder frame 26. The respective cables 37 cross over the longitudinal centerline of the watercraft 1 to provide for rotation of the rudder assembly 23 in a direction opposite from that of the steering column 24 whereby the steering action of the watercraft underway will correspond directly to the turning of the steering wheel 34.

Forwardly a suitable cowl enclosure 39 covers the drive mechanism for driving the propeller shaft 10. The cowl 39 may be hinged at 40 to provide for tilting of the cowl forwardly affording access to the mechanism.

The propeller 9 and its shaft 10 are driven by the engine 41 disposed under the cowl 39. The engine 41 is a snowmobile engine, the shaft 42 of which carries a variable sheave centrifugal pulley 43 wherein the diameter of the belt groove decreases as the engine speed increases. In the snowmobile environment the pulley 43 is commonly connected to drive the endless track that propels the snowmobile. According to the instant disclosure, the pulley 43 is drivingly connected to the variable sheave centrifugal pulley 44 by the V-belt 45. The diameter of the belt groove of pulley 44 increases with speed so that between the centrifugal pulleys 43 and 44 a favorable speed ratio obtains for driving the propeller 9.

The pulley 44 is carried on the shaft 46 which extends through the vertical framing member 47 mounted on the watercraft 1. On the opposite side of framing member 47 from pulley 44, the shaft 46 carries the sprocket 48 which is drivingly connected to a second sprocket 49 through the drive chain 50. The sprocket 49 is disposed beneath the sprocket 48 and is carried on the end of the shaft assembly 51 rotatably supported between the framing members 47 and 52 beneath the deck surface 6. The shaft assembly 51 includes the T-gear box 53 generally centrally of the assembly. The propeller shaft 10 disposed generally along the longitudinal centerline of the water craft 1 is coupled to the center power take-off of the gear box 53 by the connection 54. To minimize the drag imposed on the watercraft 1 by the propeller shaft 10, the shaft assembly 51 is generally longitudinally and horizontally aligned with the opening 8 and disposed as close as possible to the upper surface of the lift plate 5 to place the propeller shaft as near to horizontal as possible.

Because snowmobile engines come in varying sizes, and the disposition of the engine shaft and centrifugal pulleys relative thereto will also vary, accommodation is necessary for mounting the engine 41 onto the watercraft 1 to properly align the centrifugal pulley 43 carried by the engine with the centrifugal pulley 44 provided on the watercraft.

Figure 2:
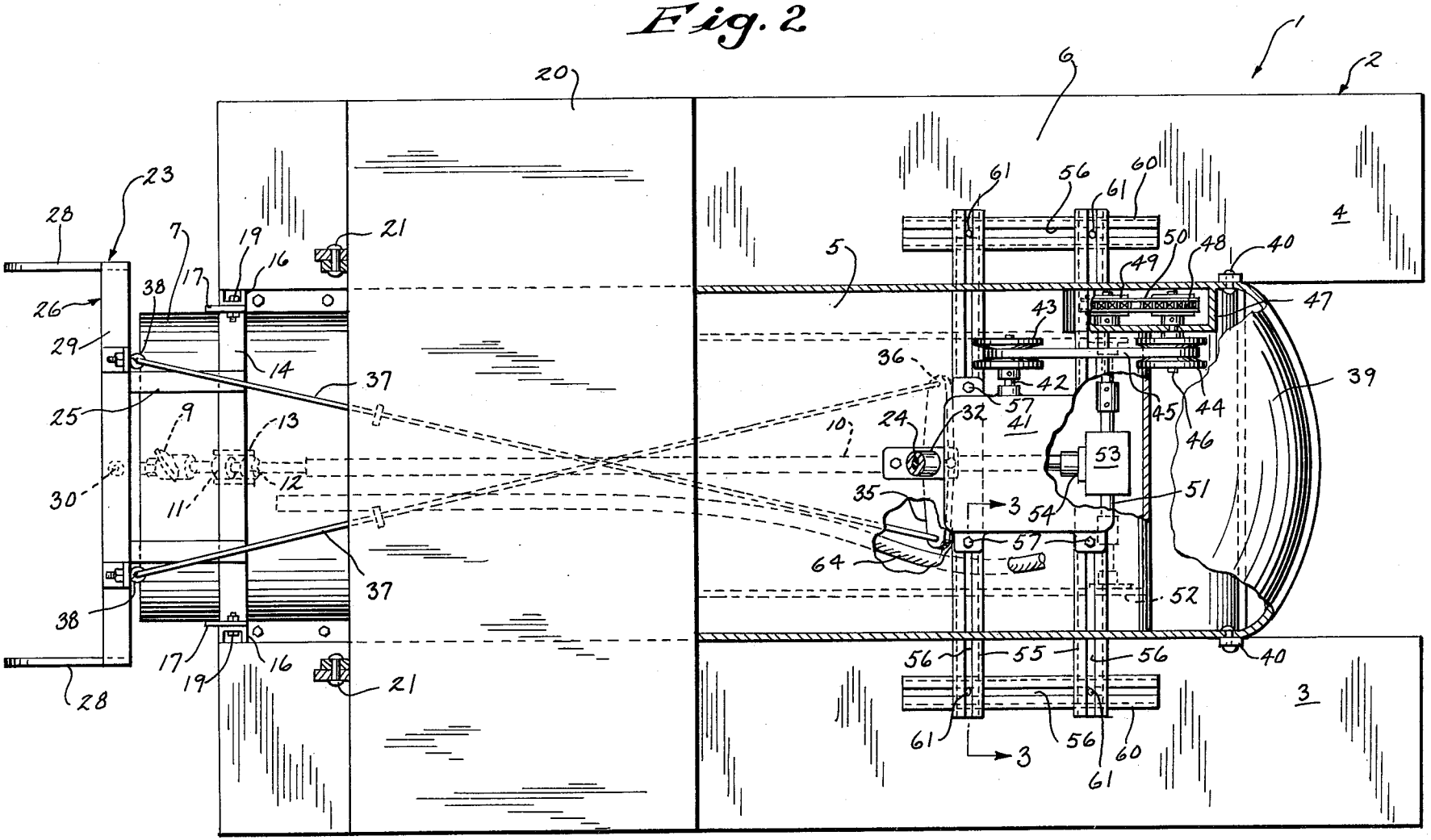
FIG. 2 is a view of the watercraft of FIG. 1 taken generally on line 2—2 and with parts broken away.

Referring particularly to FIGS. 2 and 3, the engine 41 is supported by a pair of longitudinally spaced transversely extending, hollow bars 55. The bars 55 generally comprise a box-shaped section having a relatively narrow slot 56 opening upwardly and extending over their length. Bolts 57 extend downwardly through the forwardly disposed mounting holes 58 of the engine and project through the slot 56 and into the interior of the forwardly disposed bar 55 where the bolts are engaged by nuts 59. Bolts 57 similarly extend downwardly through the rear mounting holes 58 of the engine and project through the slot 56 of the rearwardly disposed bar 55 for engagement by nuts 59. The transverse bars 55 in turn extend across and rest on longitudinally extending parallel bars 60 shown here as being secured in spaced relation on the pontoons 3 and 4. The bars 60, like bars 55, are box-shaped, section hollow members having a relatively narrow slot 56 opening upwardly and extending over their length. Bolts 61 extend downwardly through holes 62 adjacent the respective ends of the bars 55 and project through the corresponding slots 56 of the bars 60 where the bolts are engaged by the nuts 63. With the nuts 59 and 63 in a loosened condition, the engine 41 will be universally movable in a generally horizontal plane to bring the pulleys 43 and 44 into proper alignment and at a distance commensurate for the V-belt 45. With the engine 41 in proper position, the nuts 59 and 63 are tightened to secure the engine in place.

The exhaust products from the engine 41 are carried by the flexible exhaust tube 64 connected to the exhaust manifold by the coupling member 65. The exhaust tube 64 extends rearwardly above the lift plate 5 through the opening 8 so that the products of combustion are disposed of in the water beneath the wake plate 7.

Figure 4:
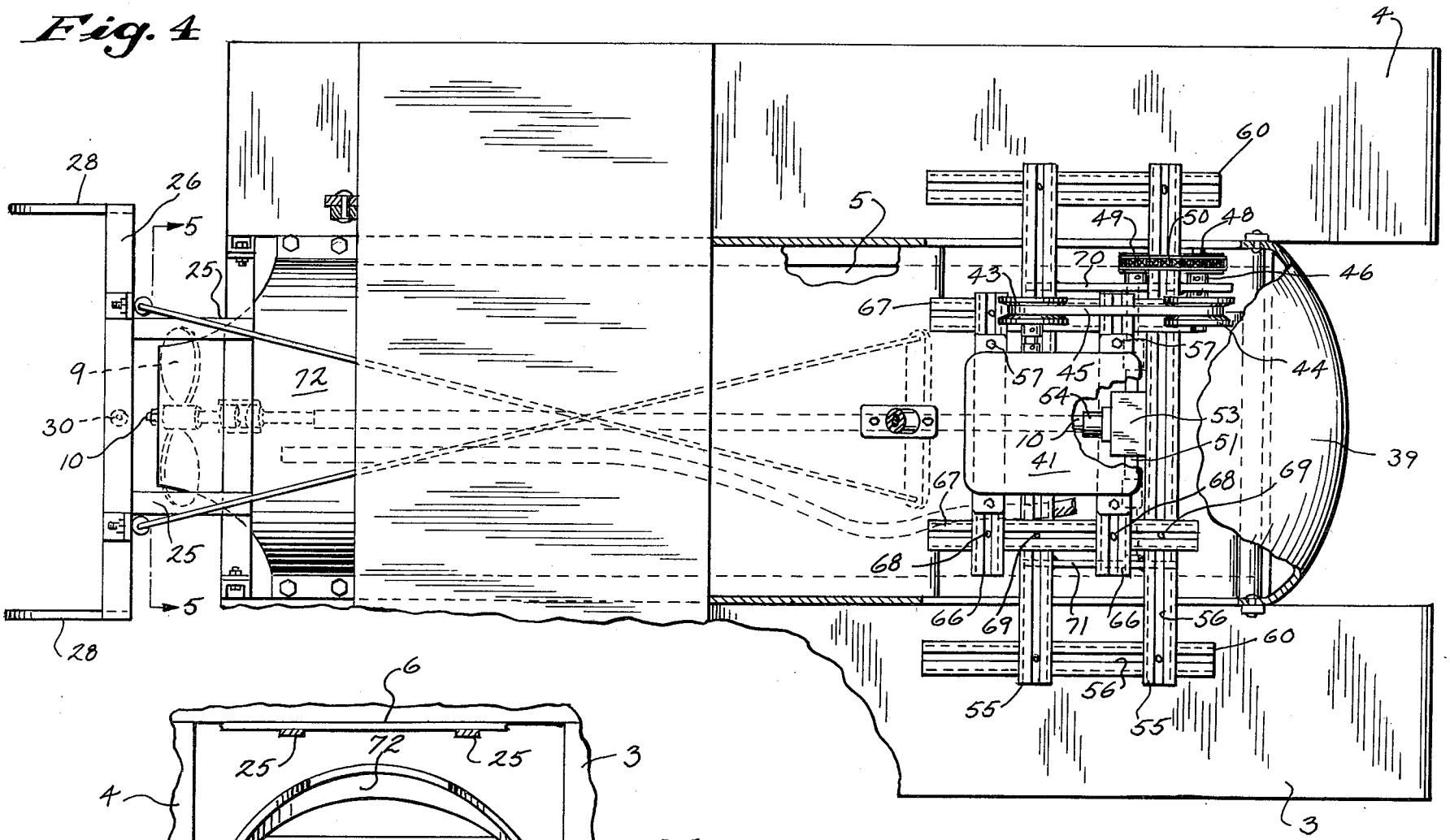
FIG. 4 is a view generally similar to that of FIG. 2 and shows a further embodiment of the invention.

In the embodiment of FIG. 4, the engine 41 is secured onto the pair of longitudinally spaced, transversely extending bars 66 by the bolts 57. The bars 66 are in turn mounted onto the pair of transversely spaced, longitudinally extending bars 67 by the bolts 68, and the bars 67 in turn are mounted on the transversely extending bars 55 by the bolts 69. The bars 66 and 67 are generally similar to the box-shaped bars 55 and 60 and also have slots 56 opening upwardly and extending the length thereof. The construction of FIG. 4 provides for alignment of the engine 41 and its variable sheave pulley 43 relative to the variable sheave pulley 44 by manipulation of the bars 67 and 68 relative to the bars 55.

The spaced bars 55 carry a pair of transversely spaced depending plates 70 and 71 welded or otherwise secured to the underside thereof. Thus, the bars 55 are fixed relative to each other by the plates 70 and 71.

Ahead of the forwardmost transverse bar 55, the plate 70 projects upwardly to rotatably support the transverse shaft 46 which mounts the pulley 44 and upper sprocket 48 on opposite sides of the plate. The shaft assembly 51 mounting the lower sprocket 49 in radial alignment with the sprocket 48 extends transversely between and is rotatably supported by the plates 70 and 71.

In the construction of FIG. 4, the bars 66 are initially spaced to receive the mounts of engine 41 and the bolts 57 are tightened to secure the engine to the bar. Thereafter, with bolts 68 and 69 loosened, the bars 66 and 67 are manipulated to bring the engine pulley 43 into proper aligned and spaced relation with respect to pulley 44 to accommodate the belt 45. With the engine 41 and its pulley 43 properly located, the bolts 68 and 69 are tightened to secure the engine in place and in fixed relation to the remainder of the drive train.

The size and weight of engines can vary considerably among snowmobiles so that the location of the engine on the watercraft 1 in relation to the fore-and-aft direction can be a significant factor in the performance of the watercraft. With a relatively heavy engine 41 too far forward, by way of example, the watercraft 1 can be precluded from coming up on plane during operation but rather will simply plow through the water even at full engine throttle. As a consequence, provision is made in the embodiment of FIG. 4 for movement of the engine 41 with the entire drive train in the fore-and-aft direction. After the engine 41 is secured in fixed relation to the remainder of the drive train, the bolts 61 securing the transverse bars 55 relative to the longitudinal bars 60 are loosened. With the bolts 61 loosened, the transverse bars 55 and the entire drive train including the engine 41 are adjustably movable longitudinally relative to the bars 60. After the bars 55 have been moved relative to the bars 60 to place the engine 41 and the balance of the drive train in position for optimum planing operation, the bolts 61 are again tightened to ready the watercraft 1 for operation.

Figure 5:
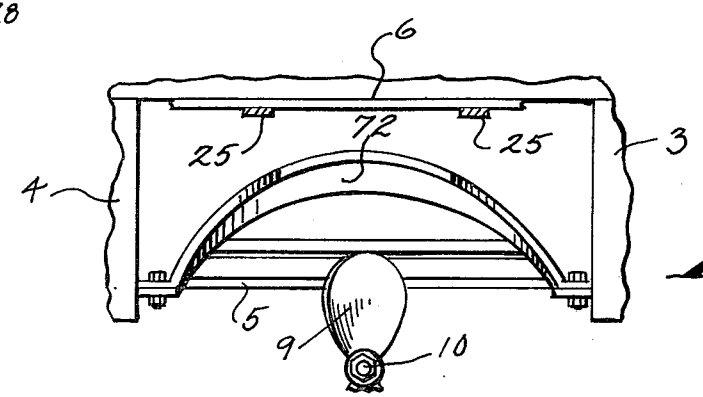
FIG. 5 is a view taken generally on line 5—5 of FIG. 4.

According to FIGS. 4 and 5, the wake plate 72 has decreasing width rearwardly from a location adjacent to the rear end of the pontoons 3 and 4 with the width of the rear edge of the wake plate approximating the radial span of the propeller 9. The decreasing width for the wake plate 72 generally eliminates any immersed, drag imposing side portions and provides a terminal portion which generally rides the water surface in operation to smooth the water flowing into the propeller 9 and so present the propeller with generally solid water.

This invention thus provides a planing watercraft requiring very little conversion. The snowmobile engine addition is well within the capability of most novices and requires only minutes to effect the conversion. Various modes of carrying out the invention are contemplated as being within the scope of the following claims particularly pointing out and distinctly claiming the subject matter which is regarded as the invention.

I claim:

1. In a watercraft, a pair of transversely spaced pontoons forming a catamaran-type hull having a deck and providing laterally spaced planing surfaces, a lift plate extending between the pontoons, said lift plate extending downwardly and rearwardly from a location spaced rearwardly from the front of the pontoons to a location spaced forwardly from the rear of the pontoons and forming a longitudinally extending recess between the pontoons, a wake plate extending between the pontoons, said wake plate being spaced above and extending rearwardly from the lift plate to form an opening therewith aligned with said recess, a longitudinally extending shaft disposed in the recess and extending rearwardly through said opening and carrying a propeller on the rear end thereof and rearwardly of said pontoons, drive means for said propeller shaft mounted on said hull and including pulley means, said drive means further including a transversely extending shaft supported beneath the deck and coupled to the forward end of the propeller shaft, said transversely extending shaft being generally longitudinally and horizontally aligned with the opening formed between the lift plate and the wake plate to provide for near horizontal mounting of the propeller shaft, and mounting means on said hull for an engine having pulley means, said engine mounting means providing for universal movement of an engine in a generally horizontal plane to place the respective pulley means into proper alignment and spaced relation to drive said propeller.

2. The structure as set forth in claim 1 wherein the wake plate extends rearwardly over the propeller and is reduced in width rearwardly from a location adjacent to the rear end of the pontoons with the width of the rear edge of the wake plate approximating the radial span of the propeller.

3. The structure as set forth in claim 1 wherein the drive means for the propeller shaft and the engine mounting means are supported on the hull by a first mounting means, said first mounting means being adjustably movable longitudinally of the hull to place the drive means and the engine mounting means in position for optimum planing operation for the watercraft.

4. The structure as set forth in claim 1 wherein a snowmobile engine having a first variable sheave centrifugal pulley is carried by the engine mounting means.

5. The structure as set forth in claim 4 wherein the pulley means of the propeller shaft drive means comprise a second variable sheave centrifugal pulley, and a V-belt drivingly connecting the variable belt grooves of the respective pulleys, the belt groove of said first pulley decreasing in diameter and the belt groove of said second pulley increasing in diameter with increasing engine speed to obtain a favorable speed ratio therebetween for driving the propeller.

6. In a watercraft, a pair of transversely spaced pontoons forming a catamaran-type hull having a deck and providing laterally spaced planing surfaces, a lift plate extending between the pontoons, said lift plate extending downwardly and rearwardly from a location spaced rearwardly from the front of the pontoons to a location spaced forwardly from the rear of the pontoons forming a longitudinally extending recess between the pontoons, a wake plate extending between the pontoons, said wake plate being spaced above and extending rearwardly from the lift plate to form an opening therewith aligned with said recess, a first mounting means, a transversely extending shaft disposed in the recess adjacent to the forward end thereof and rotatably supported by the first mounting means, a longitudinally extending shaft drivingly coupled to the transversely extending shaft and extending rearwardly through said opening and carrying a propeller on the rear end thereof rearwardly of said pontoons, said rearwardly extending wake plate projecting over the propeller, a snowmobile engine having an engine shaft carrying a first variable sheave centrifugal pulley, a second variable sheave centrifugal pulley rotatably supported on the first mounting means and being drivingly coupled to the transversely extending shaft, second mounting means for said engine and being carried by the first mounting means, said second mounting means providing for universal adjustment of the engine in a generally horizontal plane to properly align and space the first pulley relative to the second pulley, a V-belt drivingly connecting the variable belt grooves of said first and second pulleys, said belt groove of the first pulley decreasing in diameter and the belt groove of the second pulley increasing in diameter with increasing engine speed to obtain a favorable speed ratio therebetween for driving the propeller, said first mounting means being adjustably movable longitudinally of the hull to place the engine and drive elements between the engine and propeller in position for optimum planing operation for the watercraft.

7. The structure as set forth in claim 6 wherein a cowl is secured to the deck of the watercraft to enclose the engine and the forwardly disposed drive elements.

8. The structure as set forth in claim 7 wherein the cowl is hingedly connected to the deck and pivots forwardly to expose the engine and forwardly disposed drive elements.

* * * * *